United States Patent [19]

Kleven

[11] 4,110,206

[45] * Aug. 29, 1978

[54] METAL SEPARATING PROCESS AND APPARATUS

[76] Inventor: Jonny Hilmer Kleven, 1325 N. Fairview, Burbank, Calif. 91505

[ * ] Notice: The portion of the term of this patent subsequent to Feb. 15, 1994, has been disclaimed.

[21] Appl. No.: 765,268

[22] Filed: Feb. 3, 1977

Related U.S. Application Data

[63] Continuation-in-part of Ser. No. 613,366, Sep. 15, 1975, Pat. No. 4,008,152.

[51] Int. Cl.[2] ..... B03B 5/74; C22B 11/12

[52] U.S. Cl. ..... 209/43; 209/198; 209/444; 209/506

[58] Field of Search ..... 209/198–200, 209/196, 444, 434–436, 451, 452, 479, 481, 506, 43

[56] References Cited

U.S. PATENT DOCUMENTS

| | | | |
|---|---|---|---|
| 386,552 | 7/1888 | Morse | 209/506 X |
| 1,018,448 | 2/1912 | Scott | 209/200 |
| 1,986,778 | 1/1935 | Hinkley | 209/444 X |
| 2,064,554 | 12/1936 | Mahoney et al. | 209/452 |
| 2,155,587 | 4/1939 | Fairbank | 209/451 X |
| 2,618,388 | 11/1952 | Rawlings | 209/451 |
| 4,008,152 | 2/1977 | Kleven | 209/444 |

FOREIGN PATENT DOCUMENTS

| | | | |
|---|---|---|---|
| 11,894 of | 1895 | United Kingdom | 209/444 |

*Primary Examiner*—Frank W. Lutter
*Assistant Examiner*—Ralph J. Hill
*Attorney, Agent, or Firm*—Willie Krawitz

[57] ABSTRACT

Heavy metals such as mercury, gold, platinum, rhodium, osmium, silver, lead, palladium, etc., in the free state, are separated from their ore by applying water and the ore to a plurality of two to six rotating, inclined, spiral grooved wheels driven from a common shaft. The grooves are closely spaced and may have a declining pitch from the wheel at its periphery to its central annulus. The free metal tends to sink to the bottom of the grooves and the lighter ore is washed away as the metal moves along the spiral grooves to the annulus. The free metal and any remaining ore is fed from the annulus to the succeeding wheel and the process is repeated.

Mercury may be added to any of the wheels to facilitate separation of the metal from the ore. A separating wheel having a unique groove design is also disclosed.

14 Claims, 2 Drawing Figures

METAL SEPARATING PROCESS AND APPARATUS

This application is a continuation-in-part of U.S. application Ser. No. 613,366 filed Sept. 15, 1975 and now U.S. Pat. No. 4,008,152 issued Feb. 15, 1977 and incorporated herein by reference.

BACKGROUND OF THE INVENTION

This invention relates to a process and apparatus for separating heavy metals such as mercury, gold, platinum, lead, rhodium, osmium, palladium, silver, etc., in the free state from their associated ores. In some instances, the metal may be present in mine tailings which heretofore had little, if any, commercial value because of the large recovery costs, and hence were abandoned. In other instances, the metal may be present in a natural occurring ore body, but not of sufficient size to permit economic recovery by conventional processes.

Various types of apparatus have in the past been employed to recover precious metals such as gold from mine tailings raw ore, etc., using water washing techniques. One type of apparatus employed an inclined grooved wheel separator to which was fed a supply of ore that was then water washed. Gold particles sank to the bottom of the grooves, and when the wheel was rotated, the gold was moved upwardly along the grooves from the periphery of the wheel to a central orifice where it was recovered.

The basic problems when using a single wheel device or a plurality of such devices involved the necessity of feed augers for every wheel and the necessity for maintaining a uniform feed to each wheel. Also, once the beneficiated ore was removed from a wheel, it tended to dry out in a non uniform fashion; this made it difficult to feed it uniformly to a succeeding wheel even when employing a mechanical device such as an auger.

Furthermore, the use of a plurality of single separator wheel devices produced a spectrum of ore grades each of which had to be treated differently.

Consequently, the various prior art devices were limited in overall efficiency and many bodies of ore tailings still exist which contain gold and other precious metals but which heretofore could not be further economically refined with the available apparatus.

In Applicant's copending U.S. application Ser. No. 613,366, filed Sept. 15, 1975 now U.S. Pat. No. 4,008,152, there is disclosed a process and apparatus for separating heavy metals from ore employing at least three separator wheels driven from a common mounting.

However, when capital costs are included, the separator wheels are an expensive component of the apparatus.

It is therefore an object of this invention to employ fewer separator wheels and still retain the essential benefits of the invention disclosed in my copending application without undue detriment to process economics.

Another object is to provide wash water actuation which coincides with operation of the separator wheels.

Another object is to provide simultaneous alteration of the wheel inclination when in operation.

Another object is to augment the separating action by employing mercury as a phase separator.

Another object is to provide simultaneous operation of the wheels and wash water pumping and also to permit disengagement of the wheels from the drive shaft while still continuing to apply wash water to the separator wheels.

Another object is to provide a separator wheel with a unique groove design.

Other objects of this invention will become apparent from the description and drawings to follow.

SUMMARY OF THE INVENTION

According to the invention, the process and apparatus therefor provides at least two inclined, commonly driven, grooved wheels, each wheel having an outer rim to retain an ore slurry on the wheel surface. The groove are tightly packed with a minimum of flat surface between each groove so that the free flow of dressing water is not a significant factor in the process. The grooves are spiralled inwardly, usually with a declining pitch, and terminate in a central annulus which leads to a downwardly inclined feed pipe or funnel.

A succeeding wheel is fed directly from the funnel, with at as a two wheels, and as many as six wheels being employed. The number of wheels used depend on such factors as the concentration of metal in the ore, the mesh size of the ore, wheel speed, wheel size, groove spacing and design, the amount of water applied, the cohesiveness of the ore, etc. For example, a concentrate or a free-flowing sand having a high gold content could employ only two separator wheels without undue loss of efficiency. A water feed system is utilized to produce a slurry by applying water to the ore. This causes the heavy gold or other precious metal particles to settle to the bottom of the grooves and be rotated toward the center annulus of the wheel along with some ore as slurry concentrate. The slurry is fed to the funnel and gravitates downwardly to the succeeding wheel where the process is repeated. After successive treatments with at least two wheels and as many as six wheels, if necessary a highly concentrated ore, such as gold ore, is produced.

The process is not only continuous, rather than being a batch operation, but also it can be continuously controlled by regulating: a) the weight and volume of initial ore feed to the first wheel; b) the amount of water supplied; c) the inclination and; d) the rotational speed of the wheels. This permits the production not only of a concentrated ore, but also results in a high recovery which in many cases varies from about 95%–99%. Furthermore, the effect of feeding a slurry of beneficiated ore through the centrally located feed funnel totally eliminates the requirements of feed augers from wheel to wheel by producing a controlled flow of slurry during separation.

DESCRIPTION OF THE PREFERRED EMBODIMENTS

Figure 1:
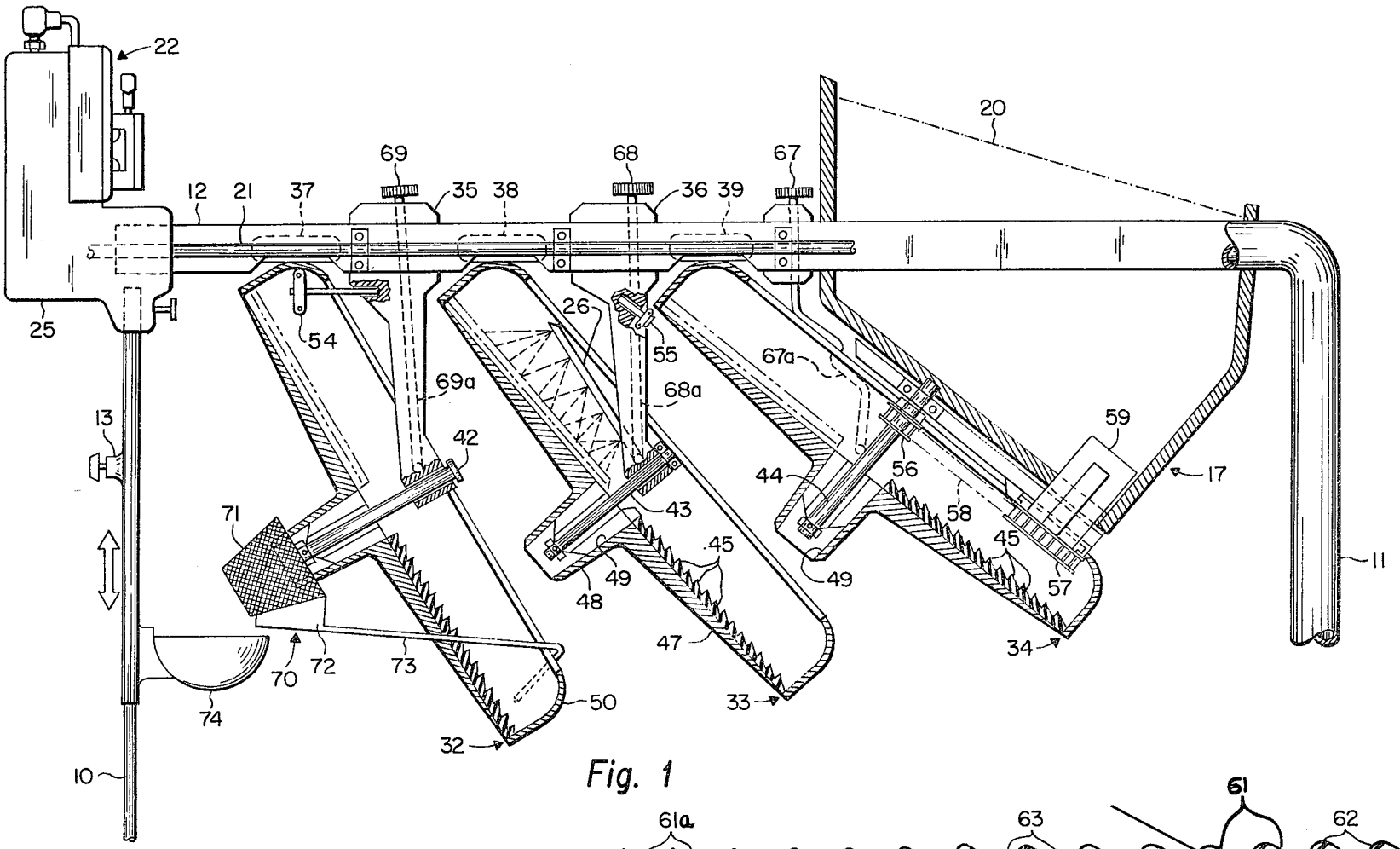
FIG. 1 is a side elevation view partially external, and in axial section showing the separating apparatus of this invention.

In FIG. 1, the separator is shown mounted on vertical support pipes 10, 11. A horizontal, hollow support bar 12 is mounted (e.g. flexibly) at one end on support pipe 10, the horizontal bar being vertically adjustable along the pipe 10 by a clamp 13, or by hydraulic means, etc. A feed hopper 17 having a screen cover 20 is mounted on support pipe 11; the hollow, horizontal bar 12 is mounted at its other end to the feed hopper. It will be appreciated that the feed hopper and screen may be eliminated and this would permit the first separator wheel to be mounted in the same manner as the remaining wheel or wheels; a simple screen would then be provided for the first wheel.

A rotatable drive shaft 21 is mounted within the horizontal bar 12, the shaft being driven by a motor 22 through a speed reducer in mounting bracket 25; a water pump (not shown) in the bracket 25 is powered from the motor and delivers water to spray bars, one spray bar 26 being shown.

A plurality of rotatable separator wheels 32, 33 and 34 are serially disposed for rotation by the drive shaft 21. Separator wheels 32, 33 are attached to brackets 35, 36 mounted on the horizontal bar 12 while separator wheel 34 is mounted to the hopper 17. The separator wheels are driven by roller drives 37, 38 and 39 which are mounted on the drive shaft 21 and rotated thereby. The separator wheels are preferably flat and pan-shaped to facilitate a serial mounting along the horizontal bar 12; the wheels are rotatably mounted on shafts 42, 43 and 44 respectively, and provide a plurality of spiral grooves 45 on their upper surfaces. Ribs 47 which terminate in a hub 48, reinforce the wheels. An annulus funnel 49 along each hub permits concentrate slurry to pass therethrough to a succeeding wheel. As noted, a separator wheel including grooves, ribs and annulus funnel, may be integrally formed from a molded plastic. Typical plastic materials include: polyurethane, epoxy, nylon, polyester, polyethylene, polypropylene, various rubbers, etc; fillers may be employed where required.

An outer rim 50, which may be integral with the wheel or constructed of similar materials as the wheel, retains ore on the wheel while it is broken down by water into a slurry for separation by the wheel into an upgraded ore and lean ore. The outer rim also functions to frictionally engage roller drives 37, 38 and 39 and is driven therefrom. If desired, the separator wheels may be urged against the roller drives by support wheels, two wheels 54, 55 being shown. The rotation of separator wheel 34 rotates gears 56, 57 through a belt 58 and this in turn rotates a feed auger 59 mounted at the bottom of the feed hopper 17; this embodiment is employed when a positive feed is required. However, a free flow or a gravity feed of the ore may be employed either alone or in conjunction with a metering valve at the hopper outlet. The wheels 32, 33 and 34 are adjustably inclined to the horizontal with a decreasing angle; typical inclinations for each wheel are about 120°-150°, 120°-140° and 100°-125°, respectively. During operation of the separator, it is usually desirable to adjust the wheel inclinations depending on load, type and quality of ore, water availability, etc. However, it is preferred, when adjusting the wheel inclinations, to adjust them simultaneously and thereby maintain the ratio of the wheel inclinations generally the same. This accomplished by vertical movement of the clamp 13. Elevation of the clamp pivots the horizontal bar 12 and the hopper 17 about pipe 11 which in turn will increase the angle of wheel inclination to the horizontal; lowering the clamp increases the angle of wheel inclination.

Figure 2:
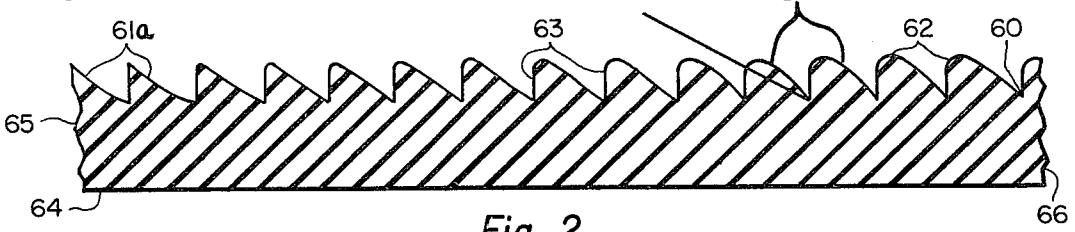
FIG. 2 is a side elevation view in axial section showing a preferred groove configuration of a separating wheel.

The grooves of the separator wheels may be saw-toothed as shown in FIG. 1; however, a preferred groove configuration is shown in FIG. 2. The grooves 60 provide trailing, curved portions 61 shaped somewhat like an airfoil, curved leading corners 62 and a lifting face 63 inclined approximately perpendicularly to wheel base 64. As the grooves travel from the wheel periphery 66 to the annulus at the center 65, the curved portion 61 becomes more flat and the corners 62 become sharper and somewhat saw-toothed **61*a* cross-section. The air-foil configurated grooves comprise about about 60%-85% of the total grooves measured along the wheel radius. The groove design of FIG. 2** greatly reduces turbulence which occurs when using sharp saw-tooth grooves. Hence, when the wash water breaks down the ore into a slurry on the moving wheel, the airfoil grooves prevent fine metal particles which have settled in the bottom of a groove to be removed by turbulence; this permits a more efficient and uniform separation of metal from the ore.

Wash water employed to slurry the raw ore is supplied from a water pump within the bracket 25 and then through spray bars to the separator wheels 32, 33 and 34 via water valves 67, 68 and 69 and through ducts **67*a*, 68*a* and 69*a*** respectively. Generally, wash water for the separator wheels is supplied in a similar fashion to that shown in my copending application, U.S. Ser. No. 613,366, now U.S. Pat. No. 4,008,152. The valves and spray bars may be individually adjusted to regulate the appropriate amount of water supplied to each separator wheel.

If desired, a mercury amalgamating system 70 may be employed. It includes a fine screen 71 mounted on the hub of separator wheel 32, a mercury collector 72, and a recycling line 73 leading to wheel 32 (or any of the wheels) at its periphery. Mercury is slowly fed automatically or manually to the separator wheel causing precious metals such as gold, silver, etc. to amalgamate with the mercury, form a dispersion therewith or sink to the bottom of the mercury. The lighter ore and water float on the mercury surface and consequently will be more easily separated from the values such as gold, silver, etc. Upon reaching the screen 71, the mercury will pass through the screen into the collector 72 and will be recycled. The coarser concentrate passes along the screen into collector 74 and is eventually recovered. Any fine gold or other values which pass through the screen along with the mercury may be recovered by evaporation of the mercury at intervals. Gold trapped in the screen itself may be recovered by suitable techniques.

Various types of ore which may be refined by the apparatus and process of this invention include: alluvial deposits, tailings, raw ore, gravel, concentrate, sand, sluice box washings, etc., and collectively are referred to as raw ore.

In operation, the separator wheels are started up by actuating the motor 22 which simultaneously supplies water through the pump 26 and to the separator wheels. Raw ore is then fed through the screen 20 to the feed hopper 17 and then fed by the auger 59 or by gravity to the periphery of the separator wheel 34 at its downwardly moving side. The raw ore is slurried by the water causing the heavy metal to fall to the bottom of the grooves 45. The lighter waste ore is washed over the top of the grooves and collects in a pool at the wheel periphery and eventually overflows and is passed to waste or further recycling. The heavier particles and a minor amount of ore are passed upwardly along the spiral grooves to the annulus funnel 49 and by the same process to the succeeding wheels 32, 33. Heavy metal such as gold, lead, etc., become concentrated while the light ore is separated and discharged to waste. A suitable type of discharge means is described in my now copending application, supra, now U.S. Pat. No. 4,008,152, and hence is omitted for convenience. During operation, the motor 22 may be disengaged from the drive shaft 21 while still applying wash water. This permits the wheel to be cleaned while preventing ore from entering the separator through the auger 59. Also, the separator can be maneuvered without endangering the operator since the wheels are not rotating.

The final concentrate, with or without the use of mercury to augment the process, is forwarded to the collector 74 and then upgraded to the pure metal. It will be appreciated that the rim-driven separator wheel of the present invention is preferable to that of a center-driven shaft since the wheel inclinations can be adjusted simultaneously. Furthermore, the use of shafts, drive belts, gears, etc., has been reduced. Also the additional clearance provided by removing belts, and drive shafts from the vicinity of the wheel eliminates problems due to water and ore splashed in these components and provides a lighter apparatus for easier transportation; also, for assembly.

Overall, the apparatus of this invention is simplified and more flexible compared to that in my copending application, supra, now U.S. Pat. No. 4,008,152.

Finally, various adjustments such as simultaneously varying the wheel inclination, motor and drive shaft disengagement, auger feed, phase separation using mercury, etc., permit the apparatus, and hence the process, to be more efficient and also to be more easily and safely operated than previously.

I claim:

1. An apparatus for separating metals in the free state from ore which comprises:

(a) a plurality of from two to six downwardly inclined, serially mounted, flat, pan-shaped separating wheels including a common shaft means for driving said wheels, each wheel providing (i) a peripheral retaining rim; (ii) a central annulus, and (iii) a plurality of spiral grooves disposed on the upper surface of each wheel and directed from the wheel periphery upwardly and inwardly to the annulus, each of said wheels being concentrically rotatable about its central annulus;

(b) means to form a water slurry with the ore on each wheel; and (c) a funnel positioned around the annulus of each wheel for forwarding upgraded ore along the spiral grooves from the annulus to a succeeding wheel.

2. The apparatus of claim 1 providing a horizontal support for the separating wheels and a vertically moveable support mounted at one end of the horizontal support, movement of the vertical support varying the inclination of the separating wheels.

3. The apparatus of claim 1 providing a horizontal support for separating wheels and a plurality of roller drives mounted on the said support for engaging and rotating each wheel at its periphery.

4. The apparatus of claim 1 in which each wheel comprises a molded plastic.

5. The apparatus of claim 1 in which each wheel comprises a molded plastic selected from the class consisting of polyester, polyurethane, polyethylene, polypropylene, nylon, epoxy, and rubbers.

6. The apparatus of claim 1 providing a shaft means for driving each separator wheel, one end of said shaft being vertically adjustable for simultaneously varying the inclination of said wheels.

7. The apparatus of claim 1 providing means for simultaneously powering a water pump to produce said water slurry and to rotate said shaft means, the shaft being disengageable from the power means while the water pump is operating.

8. The apparatus of claim 1 in which each wheel provides grooves having trailing curved portions, curved leading corners and a lifting face about perpendicular to each wheel base.

9. The apparatus of claim 1 in which each separating wheel provides grooves near the annulus having a saw tooth shape and the remaining grooves provide trailing curved portions, curved leading corners and a lifting face about perpendicular to each wheel base.

10. The separator wheel of claim 9 in which the remaining grooves comprise about 60–85% of the total grooves measured along the wheel at its radius.

11. A process for separating metals in the free state from ore which comprises the steps of:

(a) applying the ore containing the metal successively to a plurality of downwardly inclined, rotatable, flat, pan-shaped separating wheels, said wheels being driven from a common shaft and providing (i) a peripheral retaining rim, (ii) a central annulus and (iii) a plurality of spiral grooves disposed on the upper surface of each wheel and directed from the wheel periphery to the annulus, each of said wheels being concentrically rotatable about its central annulus;

(b) forming a water slurry with the ore on each wheel;

(c) washing lean ore out of the grooves and downwardly over the outer retaining rim;

(d) forwarding a slurry of upgraded ore inwardly and upwardly along the spiral grooves to the central annulus and downwardly through a funnel positioned around the annulus;

(e) applying the slurry to the next succeeding wheel; and (f) repeating the process until from two to six wheel separations are effected.

12. The process of claim 11 in which the metal is selected from the class consisting of mercury, gold, platinum, rhodium, lead, osmium, palladium, and silver.

13. The process of claim 11 in which mercury is applied to a separator wheel for augmenting the separation of heavy metal from the ore.

14. The process of claim 11 in which a separator wheel is driven from its rim and a slurry of lean ore is retained by the rim for further separation of metal and then discharged over the rim.

* * * * *